United States Patent [19]

Saito et al.

[11] 4,317,531

[45] Mar. 2, 1982

[54] ACCUMULATOR TYPE MANUAL ATOMIZER

[75] Inventors: Tadao Saito; Takao Kishi; Yoshiyuki Kakuta, all of Tokyo, Japan

[73] Assignee: Yoshino Kogyosho Co., Ltd., Tokyo, Japan

[21] Appl. No.: 158,906

[22] Filed: Jun. 12, 1980

[30] Foreign Application Priority Data

Jun. 28, 1979 [JP] Japan ..... 54-88980[U]

[51] Int. Cl.[3] ..... F04B 9/14; F04B 21/04; B05B 11/00

[52] U.S. Cl. ..... 222/321; 222/380; 222/383; 222/484

[58] Field of Search ..... 222/321, 380, 383, 385, 222/478, 484; 239/331, 333

[56] References Cited

U.S. PATENT DOCUMENTS 4,174,790 11/1979 Nozawa et al. ..... 222/321
4,189,064 2/1980 O'Neill et al. ..... 222/321

FOREIGN PATENT DOCUMENTS 2542851 4/1976 Fed. Rep. of Germany ..... 239/333
2043766 10/1980 United Kingdom ..... 239/333

*Primary Examiner*—David A. Scherbel

*Attorney, Agent, or Firm*—Stevens, Davis, Miller & Mosher

[57] ABSTRACT

An accumulator type, rechargeable atomizing spray mechanism having a container for the liquid to be atomized, and further having an atomizer body, an atomizer head, an engaging and piston member having a large-diameter rod portion. The atomizer head is arranged to cooperate with skirt-like small-diameter, intermediate-diameter and large-diameter pistons formed at a piston member. The large-diameter rod portion of the engaging and piston member forms an exhaust valve with the conical valve body projected at the top thereof and with the exhaust valve hole of the large-diameter cylinder of the atomizer head, and the small-diameter rod-like valve body of the engaging and piston member forms a suction valve with the suction valve hole and a ball valve at the lower portion of the atomizer body.

All the pistons are respectively telescopically inserted into the large-diameter cylinder, the cylindrical guide portion and the small-diameter cylindrical portion of the atomizer body. A gas is formed between the large-diameter rod portion and the small-diameter cylindrical guide to communicate the small-diameter cylindrical portion with the exhaust valve hole of said atomizer head. Since the engaging and piston member is solely formed, this atomizer can be simplified in construction.

8 Claims, 5 Drawing Figures

ACCUMULATOR TYPE MANUAL ATOMIZER

BACKGROUND OF THE INVENTION

The present invention relates to an atomizer and, more particularly, to an accumulator type atomizer of manual operation for atomizing a liquid such as perfume, cosmetic preparations or the like.

An accumulator type atomizer of manual operation in this specification means an atomizer in which when a pumping mechanism is manually operated to evacuate the interior of the accumulator chamber of a pump into a vacuum, a suction valve is opened to intake liquid contained in a container mounting an atomizer body thereat into the accumulator chamber and when the interior of the accumulator chamber is pressurized to become higher than predetermined pressure, an exhaust valve is merely opened to atomize the liquid from a nozzle outlet.

Although the atomizer of this type opens its exhaust valve only when the interior of the accumulator chamber becomes higher than predetermined pressure and closes the exhaust valve automatically when the interior of the accumulator chamber becomes lower than the predetermined pressure, it has such a disadvantage that, since high pressure lower than the predetermined pressure is residued in the accumulator chamber, the accumulator chamber is insufficiently evacuated to a vacuum due to the suction of the liquid caused by the residual pressure. It was proposed, to eliminate the above described disadvantage, to provide a hole at the upper wall surface of a cylinder forming an accumulator chamber to thereby form a residual pressure exhaust passage communicating with the hole between the outside surface of the piston or plunger telescoped within the cylinder and the inner wall surface of the cylinder to thus exhaust the residual pressure when the piston or plunger reaches its lowermost limit position. Inasmuch as the liquid contained in a container of the atomizer is exhausted together with the residual pressure in this case to cause the exhausted liquid to make contact with the upper portion of the inner wall of the container to then allow the liquid to flow down along the inner wall with the result that the liquid thus flown down adheres, in case of a transparent container, to the upper inside wall to lose its good appearance due to the liquid seen therethrough. Since the exhausted liquid is flown down upon discharge together with the residual pressure, air bubbles are mixed within the liquid contained in the container to opacify in white to thereby look like impurities mixed in the liquid in the container as an external appearance.

Inasmuch as the large-diameter cylindrical portion inserted into the peripheral wall of the atomizer head is integrally formed with the engaging member in the conventional atomizer, it is complicated to mold and form it.

SUMMARY OF THE INVENTION

It is, therefore, one primary object of the present invention to provide an accumulator type atomizer of manual operation which can eliminate the aforementioned drawbacks and disadvantages of the conventional atomizer of this type.

Another important object of the present invention is to provide an accumulator type atomizer of manual operation which can prevent the container from becoming negative pressure even by the atomizing operation of the atomizer to thereby provide the smooth priming operation thereof.

A further object of the present invention is to provide an accumulator type atomizer of manual operation which can readily manufacture and assemble the components thereof by reducing the number of the components and is inexpensive.

Still another object of the present invention is to provide an accumulator type atomizer of manual operation which can simplify the construction of the atomizer by forming the valve body of the discharge valve by the part of one component and simplifying the bottom configuration of the small-diameter cylinder thereof.

The foregoing objects and other objects will become more apparent and more readily understandable by the following description and appended claims when read in conjunction with the accompanying drawings.

DESCRIPTION OF THE PREFERRED EMBODIMENTS

Figure 1:
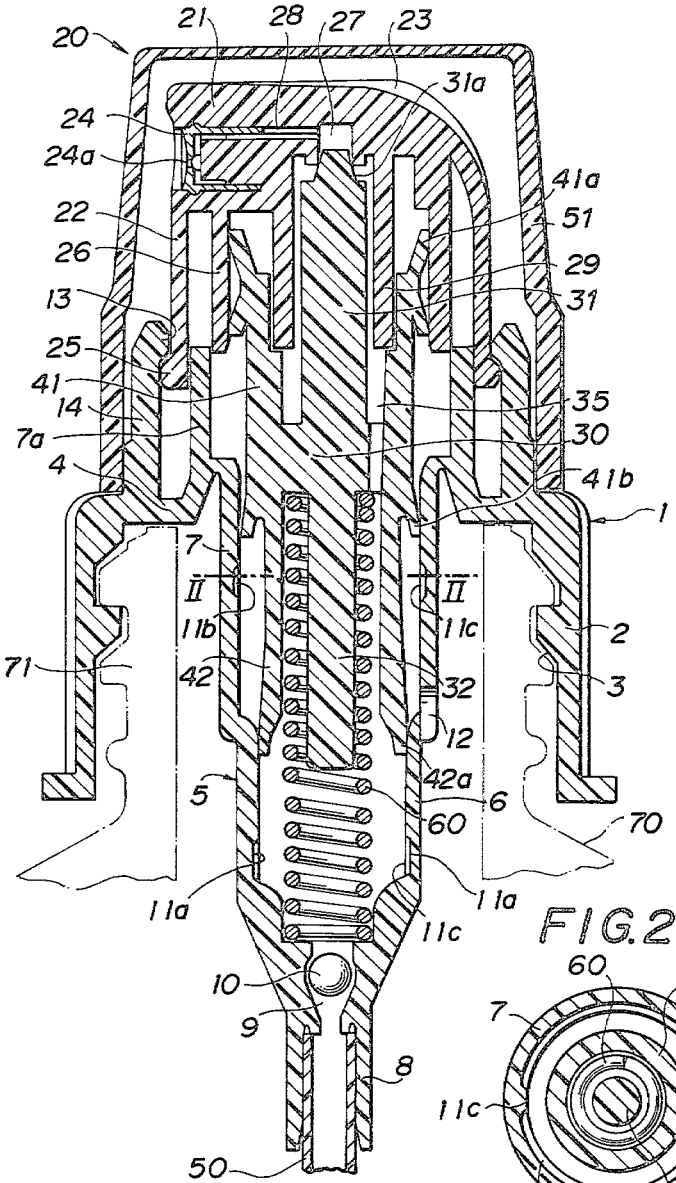
FIG. 1 is a longitudinal elevational sectional view of the upper portion of an accumulator type atomizer of manual operation showing one preferred embodiment constructed according to the present invention.
Figure 2:
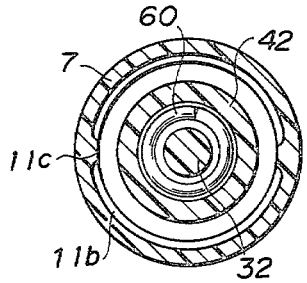
FIG. 2 is a partial sectional view of the atomizer taken along the line II—II in FIG. 1.

An accumulator type manual atomizer constructed according to one preferred embodiment of the present invention will now be described with reference to the drawings, particularly to FIGS. 1 and 2 showing the upper portion of the accumulator type atomizer constructed according to the present invention, wherein like reference numerals designate the same parts in the following views.

The accumulator type atomizer of the present invention shown and exemplified in FIG. 1 generally comprises an atomizer body 1, an atomizer head 20, an engaging and piston member 30, a suction tube 50 and a spring 60 of five essential members or components.

The atomizer body 1 has an engaging peripheral wall 2 to be engaged with the neck portion of a container body 70, and an internally threaded portion 3 formed on the inner peripheral surface of the wall 2 to be engaged with the neck portion of the container. The peripheral wall 2 is formed integrally with a radially inwardly extending flange-like upper wall 4 substantially medially thereof.

A main cylindrical portion 5 is integrally connected at the upper outer peripheral surface thereof to the inner peripheral portion of the upper wall 4. The main cylindrical portion 5 has a lower small-diameter hollow cylindrical portion 6 formed at the lower portion thereof, an upper large-diameter hollow cylindrical guide portion 7 formed at the upper portion thereof, and a suction tube engaging hollow cylindrical portion 8 integrally suspended downwardly from the lower end of the lower cylindrical portion 6. The cylindrical guide portion 7 is integrally protruded slightly upwardly at the upper half portion thereof from the flange-like upper portion 4, and is also integrally protruded downwardly at the lower half portion thereof from the flange-like upper portion 4. The peripheral wall 2 is coaxially formed with the main cylindrical portion 5. A suction valve is provided to incorporate a suction valve hole 9 and a ball valve 10 at the inside bottom of the lower cylindrical portion 6. There are formed longitudinal annular recesses 11*a* and 11*b* on the inner lower surface of the lower cylindrical portion 6 and on the inner intermediate surface of the cylindrical guide portion 7, respectively, and a hole 12 perforated at the connecting portion between the lower cylindrical portion 6 and the cylindrical guide portion 7, as will be described in greater detail, wherein longitudinal ribs 11*c* are formed in the recesses 11*a* and 11*b*. As more obviously shown in FIG. 2, one or more longitudinal ribs 11*c* are axially formed of the cylinder in the recesses 11*a* and/or 11*b* (two ribs are exemplified in FIG. 2).

An engaging tubular portion 14 is integrally extended upwardly from the upper intermediate peripheral portion of the flange-like upper wall 4 with an upper annular inward land 13 formed at the uppermost inside peripheral face thereof for preventing an atomizer head 20, which will be described in greater detail, from removing out therefrom.

The atomizer head 20 is made to depend a peripheral wall 22 integrally from the peripheral edge of a top wall 21 thereof and to also form a recess 23 on the top surface of the wall 21 for contacting with a finger. The atomizer head 20 comprises a nozzle body 24 containing a nozzle hole 24*a* perforated thereat as buried therein or detachably inserted thereto. The peripheral wall 22 of the atomizer head 20 is elevationally movably engaged telescopically with the tubular portion 14 in such a manner that the land 13 of the tubular portion 14 is engaged with a lower annular outward land 25 formed at the lowermost outside face of the peripheral wall 22 for preventing the atomizer head 20 from removing out therefrom. Reference numeral 51 designates a cover.

A large-diameter cylinder 26 is made to depend integrally from the top wall 21 inside the peripheral wall 22 of the atomizer head 20 so that a cylindrical protruded guide 7*a* integrally projected from the top wall 4 of the atomizer body 1 is telescoped in the gap between the peripheral wall 22 and the large-diameter cylinder 26 to thereby smoothly guide elevationally the atomizer head 20, and is perforated with an exhaust valve hole 27 at the center of the top wall 21 thereof. An exhaust passage 28 is formed at the top wall of the atomizer head 20 to communicate the liquid from the exhaust valve hole 27 with the nozzle hole 24*a* of the nozzle body 24.

The engaging and piston member 30 is elevationally movably inserted through the centers of the large-diameter cylinder 26, the guide portion 7 and the lower small-diameter cylindrical portion 6, and incorporates at the top thereof a large-diameter rod portion 31 elevationally movably inserted into a small-diameter cylindrical guide 29 integrally depending from the top wall 22, with a conical valve body 31*a* projected at the top thereof to thus form an exhaust valve together with the exhaust valve hole 27 of the large-diameter cylinder 26. The engaging and piston member 30 also incorporates at the lower portion thereof a small-diameter rod portion 32.

The engaging and piston member 30 also incorporates an upper half tubular portion 41 protruded upwardly outwardly from the lower portion of the large-diameter rod portion 31, and a lower half tubular portion 42 protruded downwardly outwardly from the lower portion of the large-diameter rod portion 31. The upper tubular portion 41 is formed with an upper skirt-like large-diameter piston 41*a* slidably inserted into the large-diameter cylinder 26 at the upper end of the outer periphery thereof, and is also formed with an intermediate skirt-like intermediate-diameter piston 41*b* slidably inserted into the cylindrical guide portion 7 at the lower end of the outer periphery thereof. The engaging and piston member 30 also has a lower skirt-like small-diameter piston 42*a* slidably inserted into the small-diameter cylindrical portion 6 at the lower outer periphery of the lower half tubular portion 42 thereof.

One or more liquid passages 35 are perforated through the engaging and piston member 30. A gap is formed between the large-diameter rod portion 31 and the small-diameter cylindrical guide 29 to communicate the small-diameter cylindrical portion 6 with the exhaust valve hole 27.

A suction tube 50 is engaged at the upper end thereof with the engaging cylindrical portion 8 in a manner to depend downwardly from the cylindrical portion 8 to such an extent that its lower extremity reaches the bottom wall of the container body 70. A coil spring 60 is interposed between the bottom face of the small-diameter cylindrical portion 6 and the upper bottom face formed between the small-diameter rod portion 32 and the lower half tubular portion 42 in such a manner having larger length than the conventional one to always urge the engaging and piston member 30 and the atomizer head 20 strongly upwardly for stably atomizing the liquid.

The spring 60 so urges that the small-diameter piston 42*a* is telescoped to the uppermost end of the small-diameter cylindrical portion 6, the large-diameter piston 41*a* is telescoped to the uppermost end of the large-diameter cylinder 26 and the intermediate-diameter piston 41*b* is telescoped to the uppermost end of the cylindrical guide portion 7 so that the land 25 formed at the lowermost outside face of the peripheral wall 22 of the atomizer head 20 is engaged with the upper annular inward land 13 formed at the uppermost inside peripheral face of the engaging tubular portion 14. At this time, the suction valve hole 9 is closed by the self-weight of the ball valve 10, and the exhaust valve formed by the exhaust valve hole 27 and the conical valve body 31 of the large-diameter rod portion 31 is closed at this time.

With the atomizer of these construction arrangements, when the atomizer is screwed into the neck portion 71 of a container body 70 filled with liquid, the cover 51 is removed, and the atomizer head 20 is then manually depressed against the tension of the spring 60, the air in the small-diameter cylindrical portion is compressed to become high pressure. When the skirt-like small-diameter piston 42*a* reaches the recess 11*a* formed on the lower cylindrical portion 6, the lower edge of the small-diameter piston 42*a* is engaged within the recess 11*a* to be draped therewith, but the portion of the small-diameter piston 42*a* making contact with the longitudinal rib 11*c* formed in the recess 11*a* is not draped with the recess 11*a* resulting in a slight gap retained therebetween to thereby lose a sealing function therebetween. As a result, the air thus compressed in the small-diameter cylindrical portion 6 is communicated from the gap between the small-diameter cylindrical portion 6 and the lower half tubular portion 42 and through the hole 12 with the container body 70.

When the atomizer head 20 is released from manual depression, the engaging and piston member 30 is moved upwardly by the tension of the spring 60. When the atomizer head 20 is again depressed and is then released from manual depression several times, the liquid in the container body 70 is reduced in pressure so that the liquid in the container body 70 is intaken through the suction pipe 50 into the small-diameter cylindrical portion 6 with the result that the liquid is introduced through the liquid passage 35 and the gap between the large-diameter rod portion 31 and the small-diameter cylindrical guide 29 into the periphery of the conical valve body 31*a* to be filled thereat.

Since the intermediate-diameter piston 41*b* reaches the recess 11*c* formed with ribs on the inner wall of the cylindrical guide portion 7 on the midway of depressing the atomizer head 20 to form a gap partially therebetween in the same manner as the recess 11*a* formed with ribs with respect to the small-diameter piston 42*a*, the interior of the container body 70 is communicated through the hole 12, between the intermediate-diameter piston 41*b* and the cylindrical guide portion 7, between the large-diameter piston 41*b* and the cylindrical guide portion 7, between the large-diameter cylinder 26 and the cylindrical protruded guide 7*a* and between the peripheral wall 22 and the tubular portion 14 with outer atmosphere to thereby prevent the container body 70 from becoming negative pressure or vacuum so as to smoothly conduct a priming action. When the liquid is filled in an accumulator chamber by this priming action, compressed liquid is atomized from the nozzle hole 24*a* upon depression of the atomizer head 20 next time.

The pressure receiving area of the large-diameter piston 41*a* is larger than that of the small-diameter piston 42*a*. When the pressure of the large-diameter piston 41*a* becomes larger than the tension of the spring 60, the engaging and piston member 30 is depressed to thereby lower the conical valve body 31*a* so as to thus open the exhaust valve hole 27 to thereby introduce the compressed liquid into the exhaust passage 28 to thus atomize the liquid from the nozzle hole 24*a*. When the pressure in the accumulator chamber becomes lower than the tension of the spring 60 upon atomization of the liquid from the nozzle hole 24*a*, the engaging and piston member 30 is raised by the coil spring 60 as returning stroke to thus close the exhaust valve hole 27. That is, since the valve hole 27 is opened only while the pressure in the accumulator chamber becomes predetermined value and is automatically closed when the pressure in the accumulator chamber becomes lower than the tension of the spring 60, no liquid droplet is intermittetly dropped from the nozzle hole 24*a* nor atomized therefrom, but liquid can be completely atomized from the nozzle hole 24*a*.

It should be understood from the foregoing description that since the accumulator type atomizer of this invention is thus constructed and operated according to the present invention, it can be composed of at least five essential parts and components including the spring 60 and the suction tube 50 to thereby be readily assembled and manufactured with less number of components in less expensive cost. It should also be appreciated that since the atomizer of this invention is formed with the suction and exhaust valve bodies as part of the components, it can be simplified in its construction. It should also be understood that since the atomizer of this invention is formed with the suction valve consisting of the suction valve hole and the ball valve at the bottom inside surface of the small-diameter cylindrical portion thereof and can be very easily assembled with very simplified bottom configuration of the small-diameter cylindrical portion.

Figure 3:
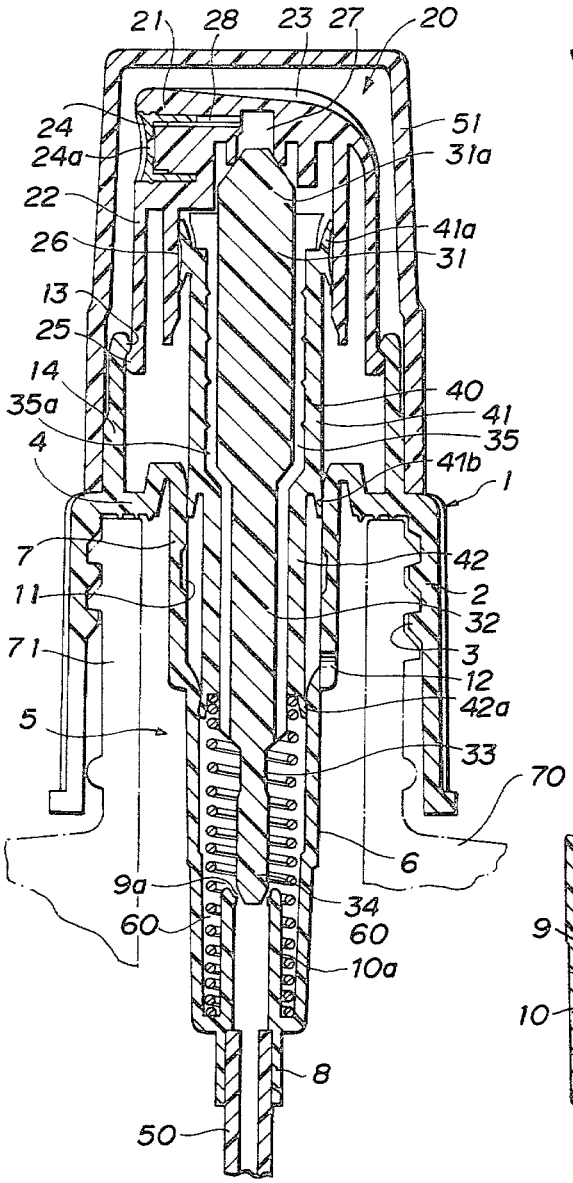
FIG. 3 is a view similar to FIG. 1 but showing another preferred embodiment constructed according to the present invention.

Referring now to FIG. 3, showing another preferred embodiment of the accumulator type atomizer constructed according to the present invention, the accumulator type atomizer shown and exemplified here generally comprises an atomizer body 1, an atomizer head 20, an engaging member 30*a*, a piston member 40, an extremely fine suction tube 50 and a coil spring 60 of six essential members or components.

A suction valve is provided at the inside bottom of the lower cylindrical portion 6, and is formed with a valve cylinder 10*a* integrally protruded upwardly from the bottom of the small-diameter cylndrical portion 6 at the inward flange thereof with a small-diameter suction valve hole 9*a* perforated through the cylinder 10*a*. There is formed an annular recess or groove 11 on the intermediate inner surface of the cylindrical guide portion 7, wherein one or more longitudinal ribs are formed therein, and a hole 12 is perforated at the connecting portion between the lower cylindrical portion 6 and the cylindrical guide portion 7.

A large-diameter cylinder 26 is made to depend integrally from the top wall 21 inside the peripheral wall 22 of the atomizer head 20, and is perforated with an exhaust valve hole 27 at the center of the top wall 21 thereof.

An engaging member 30*a* is provided longitudinally at the center from the large-diameter cylinder 26 to the small-diameter hollow cylindrical portion 6, and incorporates at the top thereof a large-diameter rod portion 31 with a conical valve body 31*a* projected at the top to form an exhaust valve together with the exhaust valve hole 27 of the large-diameter cylinder 26.

The engaging member 30*a* also incorporates at the intermediate portion thereof an intermediate-diameter rod portion 32, and at the lower portion thereof a small-diameter guide rod portion 34 to be watertightly inserted into the suction valve hole 9*a* to form a suction valve together with the guide rod portion 34 and the suction valve hole 9*a* of the valve cylinder 10*a*. As more clearly illustrated in FIG. 5, a reduced-diameter portion 33 is formed at the upper portion of the guide rod portion 34 to escape the air through the suction tube 50 when priming the atomizer to thereby reduce the number of priming times efficiently.

Figure 4:
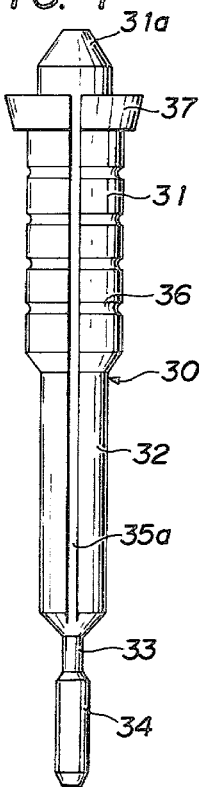
FIG. 4 is a longitudinal side view of the engaging member used in the atomizer shown in FIG. 3.

With reference to FIG. 4, the engaging member 30*a* incorporates a liquid suction groove or grooves 35*a* perforated radially at both sides thereof as shown in FIG. 3 to thus form a passage for supplying liquid from the suction valve to the exhaust valve of the atomizer head 20. Referring to FIG. 4, the engaging member 30*a* also incorporates a plurality of lateral grooves 36 formed at predetermined interval on the large-diameter rod portion 31 to communicate with the vertical grooves 35*a* to smoothly supply the liquid from the container body 70 from the suction valve to the exhaust valve.

The engaging member 30*a* also incorporates at the upper portion thereof an upper pressure receiving land 37 projected therefrom to recieve the liquid pressure on the top surface thereof.

When the small-diameter cylindrical portion 6 communicates with the large-diameter cylinder 26 through the vertical grooves 35*a* to become the same or higher pressure, the small-diameter rod portion 32 is depressed by the pressure receiving area of the land 37 including the piston 41*a* against the tension of the spring 60 to thereby continue atomizing the liquid. When the pressure in the cylinder 26 becomes lower than the tension of the spring 60, the valve body 31*a* closes the valve hole 27 to thereby stop atomizing the liquid.

A piston member 40 has an upper half tubular portion 41 secured to the outer periphery of the large-diameter rod portion 31 of the engaging member 30*a* and formed with an upper skirt-like large-diameter piston 41*a* slidably inserted into the large-diameter cylinder 26 at the upper end of the outer periphery thereof, and a lower half tubular portion 42 slidably engaged on the outer periphery of the intermediate-diameter rod portion 32 of the engaging member and formed with an intermediate skirt-like intermediate-diameter piston 41*b* slidably inserted into the cylindrical guide portion 7.

The piston member 40 also has a lower skirt-like small-diameter piston 42*a* slidably inserted into the small-diameter cylindrical portion 6 at the lower outer periphery of the lower half tubular portion 42 thereof.

It is noted that since the engaging member 30 incorporates the vertical grooves 35*a*, the inner surfaces of the tubular portions 41 and 42 may be contacted watertightly with the large-diameter and intermediate-diameter rod portions 31 and 32 to stabilize thereby the elevational movements of the engaging members 30*a*.

A suction tube 50 is engaged at the upper end thereof with the engaging cylindrical portion 8 in a manner to depend downwardly from the cylindrical portion 8 to such an extent that its lower extremity reaches the bottom wall of the container body.

A coil spring 60 is interposed between the main cylindrical portion 5 of the atomizer body 1 and the piston member 40 to always urge the piston member 40, the engaging member 30*a* and the atomizer head 20 upwardly.

The spring 60 so urges that the small-diameter piston 42*a* is telescoped to the uppermost end of the small-diameter cylindrical portion 6, the large-diameter piston 41*a* is telescoped to the uppermost end of the large-diameter cylinder 26 and the intermediate-diameter piston 41*b* is telescoped to the uppermost end of the cylindrical guide portion 7 so that the land 25 formed at the lowermost outside face of the peripheral wall 22 of the atomizer head 20 is engaged with the upper annular inward land 13 formed at the uppermost inside peripheral face of the engaging tubular portion 14. At this time, the suction valve formed with the suction valve hole 9*a* and the guide rod portion 34 is opened, and the exhaust valve formed with the exhaust valve hole 27 and the conical valve body 31*a* formed at the large-diameter rod portion 31 at the upper portion of the engaging member 30*a* is closed at this time.

With the atomizer of these construction arrangements, when the atomizer is screwed into the neck portion 71 of the container body 70 filled with liquid and the atomizer head 20 is manually depressed against the tension of the spring 60, since the air is filled within an accumulator chamber consisting of the large-diameter cylindrical portion 31, the small-diameter cylindrical portion 6 and the piston member 40, the valve body 33 is slidably inserted into the suction valve hole 9 to thereby close the suction valve. Then, as the atomizer head 20 is depressed down, the accumulator chamber is gradually increased under pressure.

Figure 5:
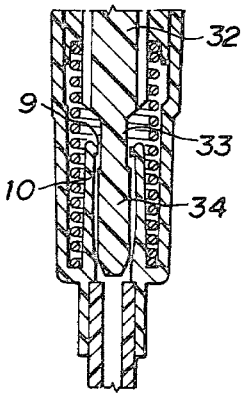
FIG. 5 is a partially enlarged sectional view of the lower portion of the atomizer shown in FIG. 3.

When the guide rod portion 34 reaches its lowermost limit, the accumulator chamber is communicated through the reduced-diameter portion 33 with the suction tube 50 as shown in FIG. 5 so that the air in the accumulator chamber is escaped through the suction tube 50 into the container body 70. Since the air is escaped through the tube 50 into the container body 70 at priming time in this case, the tube 50 may be thinner than that exemplified in FIG. 1. Thus, the piston member 40 is thus telescoped upwardly with respect to the engaging member 30*a* due to the tension of the spring 60 to thereby close the exhaust valve. When the atomizer head 20 is released from manual depression in this state, the piston member 40, the engaging member 30*a* and the atomizer head 20 are moved upwardly as they are. Since the accumulator chamber is evacuated to vacuum or negative pressure due to the upward movement of these members, the suction valve is opened to intake the liquid contained in the container body 70 through the suction tube 50. When the atomizer head 20 is then depressed, compressed liquid is atomized from the nozzle hole 24*a*.

It is noted that the reduction of the liquid in the container should evacuate to negative pressure in the container, but when the intermediate-diameter piston 44 reaches the annular recess 11 formed on the intermediate inner surface of the cylindrical guide portion 7, a passage is formed between the outer surface of the tubular portion 41 of the piston member 40 and the inner surface of the cylindrical guide portion 7 through the annular recess 11 formed with the vertical ribs to thereby inflow the atmospheric air through the hole 12 to thus prevent the negative pressure in the container body.

It should be understood from the foregoing description that since the large-diameter cylinder 26 is integrally depended from the center of the atomizer head 20, the atomizer of this invention can reduce the number of components and simplify its construction.

What is claimed is:

1. A liquid spraying device comprising;

a container for liquid, an atomizer body having an engaging peripheral portion engaged with the neck portion of said container and holding a main cylindrical guide portion formed at the lower portion thereof with a lower small-diameter hollow cylindrical guide portion via a radially inwardly extending flange-like upper wall projected from the upper end of the engaging peripheral portion, An atomizer head formed with a nozzle hole perforated at a nozzle body detachably inserted thereto to depend a peripheral wall integrally from the peripheral edge of a top wall thereof and having a large-diameter cylinder depending integrally from the top wall inside the peripheral wall thereof so that a cylindrical protruded guide integrally projected from the top wall of said atomizer body is telescoped in the gap between the peripheral wall and the large-diameter cylinder, perforated with an exhaust valve hole at the center of the top wall thereof and formed with an exhaust passage at the top wall of said atomizer head to communicate the liquid from the exhaust valve hole with the nozzle hole of said nozzle body, an engaging and piston member having a large-diameter rod portion elevationally movably inserted into a small-diameter cylindrical guide integrally depending from the top wall of said atomizer head with a conical valve body projected at the top thereof for forming an exhaust valve together with the exhaust valve hole of the large-diameter cylinder of said atomizer head, a small-diameter rod portion formed at the lower portion thereof, an upper half tubular portion protruded upwardly outwardly from the lower portion of the large-diameter rod portion thereof, a lower half tubular portion protruded downwardly outwardly from the lower portion of the large-diameter rod portion thereof so that the upper half tubular portion is formed with an upper skirt-like large-diameter piston slidably inserted into the large-diameter cylinder of said atomizer head at the upper end of the outer periphery thereof and is also formed with an intermediate skirt-like intermediate-diameter piston slidably inserted into the cylindrical guide portion of said atomizer body at the lower end of the outer periphery thereof, and a lower skirt-like small-diameter piston slidably inserted into the small-diameter cylindrical portion of said atomizer body at the lower outer periphery of the lower half tubular portion thereof, one liquid passage perforated therethrough with a gap formed between the large-diameter rod portion and the small-diameter cylindrical guide portion to communicate the small-diameter cylindrical portion with the exhaust valve hole of said atomizer head, a suction tube engaged at the upper end thereof with the engaging cylindrical portion of said atomizer body in a manner to depend downwardly from the cylindrical portion of said atomizer body for intaking the liquid in said container, and a spring means arranged between the bottom face of the small-diameter cylindrical portion and the upper bottom face formed between the small-diameter rod portion thereof and the lower half tubular portion thereof in such a manner for always urging upwardly said engaging and piston member and said atomizer head strongly, said atomizer body having a suction valve hole provided at the inside bottom of said small-diameter cylindrical portion together with a ball valve.

2. A liquid spraying device as claimed in claim 1 in which longitudinal annular recesses are formed on the inner lower surface of the lower cylindrical portion of said atomizer body and on the inner intermediate surface of the cylindrical guide portion of said atomizer body, and a hole is perforated at the connecting portion between the lower cylindrical portion and the cylindrical guide portion of said atomizer body.

3. A liquid spraying device as claimed in claim 2 in which at least one longitudinal rib is formed in each of the recesses.

4. A liquid spraying device comprising:

a container for liquid, an atomizer body having an engaging peripheral portion engaged with the neck portion of said container and holding a main cylindrical guide portion formed at the lower portion thereof with a lower small-diameter hollow cylindrical portion with a suction valve hole at its lower end via a radially inwardly extending flange-like upper wall projected from the upper end of the engaging peripheral portion, an atomizer head formed with a nozzle hole perforated at a nozzle body detachably inserted thereto to depend a peripheral wall integrally from the peripheral edge of a top wall thereof and having a large-diameter cylinder depending integrally from the top wall inside the peripheral wall thereof, perforated with an exhaust valve hole at the center of the top wall thereof and formed with an exhaust passage at the top wall of said atomizer head to communicate the liquid from the exhaust valve hole with the nozzle hole of said nozzle body, a suction tube engaged at the upper end thereof with the engaging cylindrical portion in a manner to depend downwardly from the cylindrical portion of said atomizer body for intaking the liquid in said container, an engaging member having a large-diameter rod portion with a conical valve body projected at the top thereof for forming an exhaust valve together with the exhaust valve hole of the large-diameter cylinder of said atomizer head, an intermediate-diameter rod portion formed at the intermediate portion thereof, a small-diameter guide rod portion formed at the lower portion thereof for forming a suction valve together with the guide rod portion and the suction valve hole of the valve cylinder of said atomizer body, and a reduced-diameter portion formed at the upper portion of the guide rod portion thereof to escape the air through the suction tube when priming said atomizer, a piston member having an upper half tubular portion secured to the outer periphery of the large-diameter rod portion of said engaging member and formed with an upper skirt-like large-diameter piston slidably telescoped into the large-diameter cylinder of said atomizer head at the upper end of the outer periphery thereof, a lower half tubular portion slidably engaged on the outer periphery of the intermediate-diameter rod portion of said engaging member and formed with an intermediate skirt-like intermediate-diameter piston slidably telescoped into the cylindrical guide portion of said atomizer body, and a lower skirt-like small-diameter piston slidably telescoped into the small-diameter cylindrical portion of said atomizer body at the lower outer periphery of the lower half tubular portion thereof, and spring means arranged between the main cylindrical portion of said atomizer body and said piston member to always urge said piston member, said engaging member and said atomizer head upwardly, said atomizer body having a suction valve formed with a guide rod portion and a suction valve hole of the valve cylinder.

5. A liquid spraying device as claimed in claim 4 in which an annular recess is formed on the intermediate inner surface of the cylindrical guide portion of said atomizer body, wherein one or more longitudinal ribs are formed therein, and a hole is perforated at the connecting portion between the lower cylindrical portion and the cylindrical guide portion of said atomizer body.

6. A liquid spraying device as claimed in claim 4 in which a liquid suction groove is perforated radially at least one side of said engaging member for forming a passage for supplying liquid from the suction valve to the exhaust valve of said atomizer head.

7. A liquid spraying device as claimed in claim 4 in which said engaging member comprises a plurality of lateral grooves formed at predetermined interval on the large-diameter rod portion thereof to communicate with the vertical groove for smoothly supplying the liquid from said container from the suction valve to the exhaust valve.

8. A liquid spraying device as claimed in claim 4 in which said engaging member comprises at the upper portion thereof an upper pressure receiving land projected therefrom for receiving the liquid pressure on the top surface thereof.

* * * * *